US006346803B1

(12) United States Patent
Grossnickle et al.

(10) Patent No.: US 6,346,803 B1
(45) Date of Patent: Feb. 12, 2002

(54) CURRENT REFERENCE

(75) Inventors: Vaughn J. Grossnickle, Hillsboro; Siva G. Narendra; Vivek K. De, both of Beaverton, all of OR (US)

(73) Assignee: Intel Corporation, Santa Clara, CA (US)

( * ) Notice: Subject to any disclaimer, the term of this patent is extended or adjusted under 35 U.S.C. 154(b) by 0 days.

(21) Appl. No.: 09/727,173

(22) Filed: Nov. 30, 2000

(51) Int. Cl.[7] ..... G05F 3/16
(52) U.S. Cl. ..... 323/315
(58) Field of Search ..... 323/312, 315, 323/316; 330/257, 288; 327/534, 535, 537, 538, 543

(56) References Cited

U.S. PATENT DOCUMENTS 4,342,926 A * 8/1982 Whatley ..... 307/297
4,461,991 A * 7/1984 Smith ..... 323/312
5,300,837 A 4/1994 Fischer ..... 307/491
5,619,164 A 4/1997 Tomishima ..... 327/541
5,654,665 A 8/1997 Menon et al. ..... 327/541
5,703,497 A 12/1997 Min ..... 326/33
5,894,236 A 4/1999 Mizaguchi et al. ..... 327/108
5,903,141 A * 5/1999 Tailliet ..... 323/312
5,914,868 A 6/1999 Han et al. ..... 363/60
5,939,933 A * 8/1999 Wang ..... 327/512
6,188,270 B1 * 2/2001 Boerstler ..... 327/543

* cited by examiner

*Primary Examiner*—Matthew Nguyen
(74) *Attorney, Agent, or Firm*—Schwegman, Lundberg, Woessner & Kluth, P.A.

(57) ABSTRACT

A current reference has two control transistors sized and biased to generate two control currents. The two control currents change over process variations such that the difference between the two currents remains substantially constant over process variations. A current mirror receives and mirrors the difference current to provide a substantially process-independent output current.

25 Claims, 4 Drawing Sheets

CURRENT REFERENCE

FIELD

The present invention relates generally to current references, and more specifically to process-independent current references.

BACKGROUND

Current references are circuits that are designed to provide constant current. The constant current is utilized in other circuits, and the design of these other circuits typically relies on the current being constant. One problem with current references is that the current provided can be sensitive to voltage, temperature, and process variations. That is to say, as the voltage, temperature, or process parameters (such as transistor threshold voltages) vary, the current generated by the current reference also varies.

Known current reference circuits exist that are relatively insensitive to voltage and temperature variations. See, for example, Sueng-Hoon Lee and Yong Jee, "A Temperature and Supply-Voltage Insensitive CMOS Current Reference," IEICE Trans. Electron., Vol.E82-C, No.8 August 1999.

Some known current reference circuits also compensate for process variations. Existing process compensation mechanisms, which typically require the use of at least one package pin for an off-chip precision resistor, typically can achieve variations as low as +/−5 to +/−10%. Typical variations in process uncompensated bias currents can be in the range of +/−30%.

For the reasons stated above, and for other reasons stated below which will become apparent to those skilled in the art upon reading and understanding the present specification, there is a need in the art for a process-independent current reference that does not use an external precision resistor.

DESCRIPTION OF EMBODIMENTS

Figure 1:
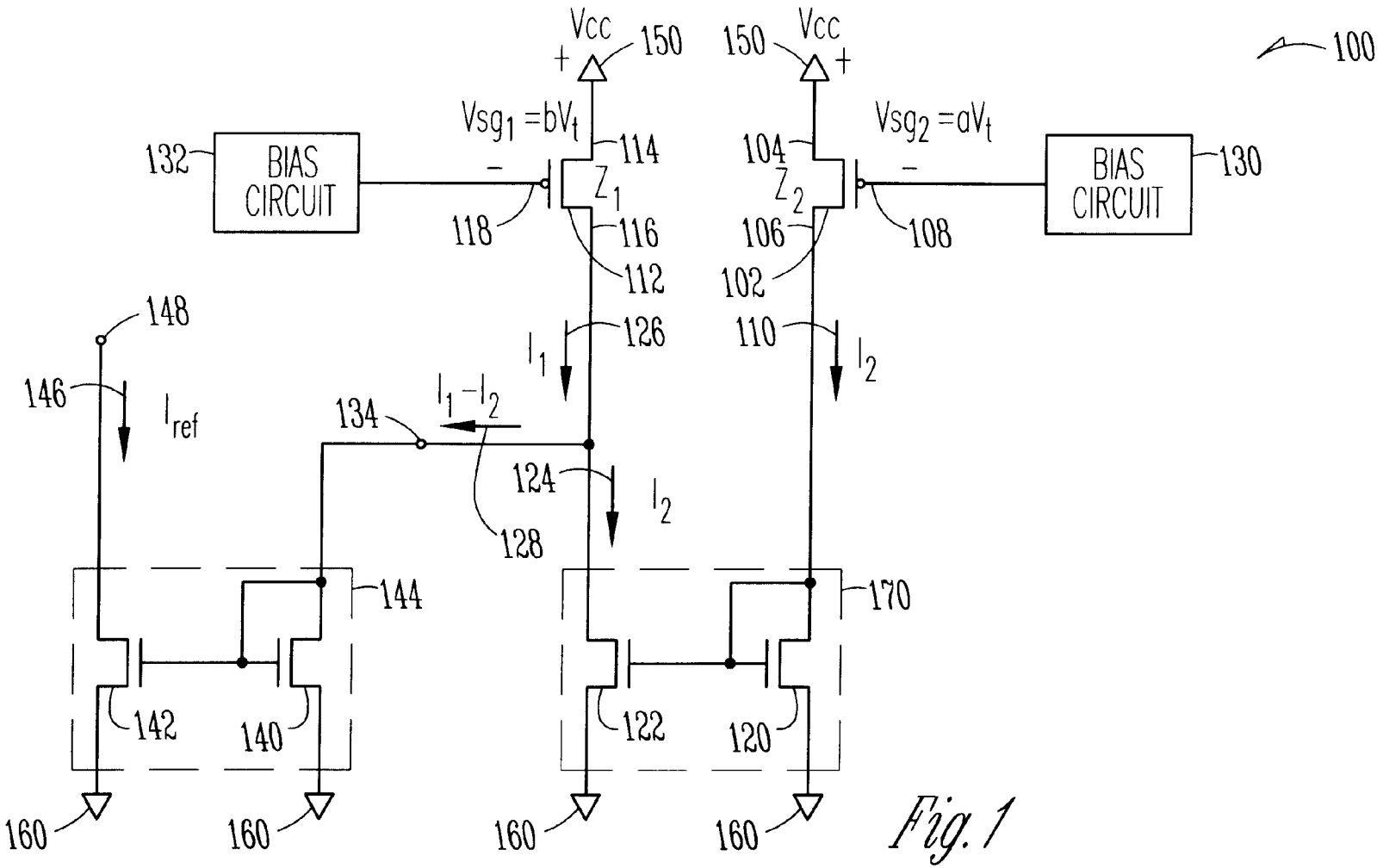
FIG. 1 shows a current reference circuit.

In the following detailed description of the embodiments, reference is made to the accompanying drawings which show, by way of illustration, specific embodiments in which the invention may be practiced. In the drawings, like numerals describe substantially similar components throughout the several views. These embodiments are described in sufficient detail to enable those skilled in the art to practice the invention. Other embodiments may be utilized and structural, logical, and electrical changes may be made without departing from the scope of the present invention. Moreover, it is to be understood that the various embodiments of the invention, although different, are not necessarily mutually exclusive. For example, a particular feature, structure, or characteristic described in one embodiment may be included within other embodiments. The following detailed description is, therefore, not to be taken in a limiting sense, and the scope of the present invention is defined only by the appended claims, along with the full scope of equivalents to which such claims are entitled.

The method and apparatus of the present invention provide a mechanism to generate a substantially process-independent current without the use of an external precision resistor. A current reference has two control transistors sized and biased to generate two control currents. The two control currents change over process variations such that the difference between the two currents remains substantially constant over process variations.

FIG. 1 shows a current reference circuit. Current reference circuit 100 includes current mirrors 170 and 144, control transistors 102 and 112, and bias circuits 130 and 132. Control transistor 102 is a p-channel transistor with source 104, gate 108, and drain 106. Source 104 is coupled to upper power supply node 150, shown as $V_{cc}$ in FIG. 1. Gate 108 is coupled to bias circuit 130, and drain 106 is coupled to current mirror 170. Control transistor 112 is also a p-channel transistor with source 114, gate 118, and drain 116. Source 114 is coupled to upper power supply node 150, gate 118 is coupled to bias circuit 132, and drain 116 is coupled to current mirror 170. Control transistor 102 has a size given by $$z_2 = \frac{W_2}{2L_2} \tag{1}$$

where $W_2$ is the channel width and $L_2$ is the channel length, and control transistor 104 has a size given by $$z_1 = \frac{W_1}{2L_1} \tag{2}$$

where $W_1$ is the channel width and $L_1$ is the channel length.

In some embodiments, control transistors 102 and 104 are "long channel" devices. A long channel device is one that has a channel from source-to-drain that is longer than the minimum dimension for the process in which it is manufactured. Using long channels can aid in avoiding process variations related to small lateral dimensions. Short channel devices can also be used. When short channel devices are used, circuit analysis can become more complicated in part because certain assumptions cannot be made.

Control transistors 102 and 104 are biased and sized to generate control currents. For example, control transistor 102 generates a first control current 110, shown as "$I_2$" in FIG. 1. Bias circuit 130 provides a source-to-gate bias voltage of $$V_{sg_2}=aV_t \tag{3}$$

where "a" is a constant, and $V_t$ is the threshold voltage of control transistor 102. Also for example, control transistor 104 generates a second control current 126, shown as "$I_1$" in FIG. 1. Bias circuit 132 provides a source-to-gate bias voltage of $$V_{sg_1}=bV_t \tag{4}$$

where "b" is a constant, and $V_t$ is the threshold voltage of control transistor 104.

Bias circuits 130 and 132 provide a different bias voltage as the threshold voltage changes over process variation. For example, in one integrated circuit, the threshold voltage of transistors 102 and 104 may be low as a result of manufacturing process variations. In this integrated circuit, bias circuits 130 and 132 provide a correspondingly low bias voltage. In another integrated circuit, the threshold voltages of transistors 102 and 104 may be high as a result of manufacturing process variations. In this integrated circuit, bias circuits 130 and 132 provide a correspondingly high bias voltage. Bias circuit embodiments are described with reference to later figures.

Current mirror 170 includes diode-connected transistor 120 and second transistor 122 to produce current 124, which, in the embodiment shown in FIG. 1, is substantially equal to $I_2$. The term "diode-connected" as used herein, refers to a transistor that has a gate tied to a drain, such that the gate-to-source voltage and the drain-to-source voltage are equal. In other embodiments, diode-connected transistor 120 and second transistor 122 are sized such that currents 124 and 110 are related, but are not equal. Current mirrors, such as current mirror 170, are well known.

Node 134 is an output node of the circuit that includes current mirror 170 and control transistors 102 and 104. Current 128, which is the difference between the first and second control currents 110 and 126, flows on node 134. Node 134 is also an input to current mirror 144. Current mirror 144 includes diode-connected transistor 140 and second transistor 142 to generate current 146, shown as "$I_{ref}$" in FIG. 1. In the embodiment shown in FIG. 1, current 146 is substantially equal to current 128 because the transistors within current mirror 144 are sized substantially the same. In other embodiments, the transistors within current mirror 144 are sized differently, and current 146 is a function of current 128 and the relative sizes of transistors 140 and 142. In some embodiments, current mirror 144 is not included in current reference circuit 100, and node 134 is the current reference circuit output node.

The method and apparatus of the present invention provide a mechanism to size and bias control transistors 102 and 104 such that current 128 is substantially process-independent even though currents 110 and 126 are not. The operation of current reference circuit 100 is now presented, aided by mathematical analysis as appropriate.

Control transistors 102 and 104 are operated in a saturation region. Current 110 ($I_2$) is given by $$I_2=\beta z_2(V_{sg_2}-V_t)^2 \tag{5}$$

and current 126 ($I_1$) is given by $$I_1=\beta z_1(V_{sg_1}-V_t)^2 \tag{6}$$

where $$\beta=\mu C_{ox} \tag{7}$$

which represents mobility multiplied by oxide capacitance. The remaining analysis assumes that control transistors 102 and 104 have been designed to have matched threshold voltages and oxide thicknesses.

Making an assumption that process-dependent changes in source-to-drain currents are largely caused by variations in $\beta$ and $V_t$ and assuming that $\mu$ is not a strong function of channel doping, the change in $I_1$ is given by:

$$\frac{dI_1}{dP} \approx z_1(V_{sg_1}-V_t)^2\frac{d\beta}{dP} - 2z_1\beta(V_{sg_1}-V_t)\frac{d\beta}{dP}\frac{dV_t}{d\beta} \tag{8}$$

and the change in $I_2$ is given by:

$$\frac{dI_2}{dP} \approx z_2(V_{sg_2}-V_t)^2\frac{d\beta}{dP} - 2z_2\beta(V_{sg_2}-V_t)\frac{d\beta}{dP}\frac{dV_t}{d\beta}. \tag{9}$$

Equations (8) and (9) include terms that describe the change in current due to changes in $\beta$, and also the change in current due to changes in $V_t$. Equating changes in $I_1$ due to changes in $\beta$ with changes in $I_2$ due to changes in $V_t$ yields $$z_1(V_{sg_1}-V_t)^2 = 2z_2\beta(V_{sg_2}-V_t)\frac{dV_t}{d\beta} \tag{10}$$

and equating changes in $I_2$ due to changes in $\beta$ with changes in $I_1$ due to changes in $V_t$ yields $$z_2(V_{sg_2}-V_t)^2 = 2z_1\beta(V_{sg_1}-V_t)\frac{dV_t}{d\beta}. \tag{11}$$

Combining equations (3), (4), (10), and (11) produces the equations $$(a-1)(b-1)=4 \tag{12}$$

and $$\frac{z_1}{z_2}=\left(\frac{a-1}{b-1}\right)^{\frac{3}{2}}. \tag{13}$$

To achieve a non-zero process-compensated current, $I_{ref}=I_1-I_2$, with reduced $dI_{ref}/dP$, control transistors 102 and 104 are biased and sized such that equations (12) and (13) are satisfied. An infinite number of embodiments are described by equations (12) and (13) because they are continuous functions. Table 1 shows five possible sets of values that satisfy equations (12) and (13).

TABLE 1

| Set | a | b | z1/z2 | Iref = I1 − I2 |
|---|---|---|---|---|
| 1 | 2 | 5 | 1/8 | non-zero |
| 2 | 2.33 | 4 | 8/27 | non-zero |
| 3 | 2.5 | 3.66 | 27/64 | non-zero |
| 4 | 2.6 | 3.5 | 64/125 | non-zero |
| 5 | 3 | 3 | 1 | zero |

Figure 2:
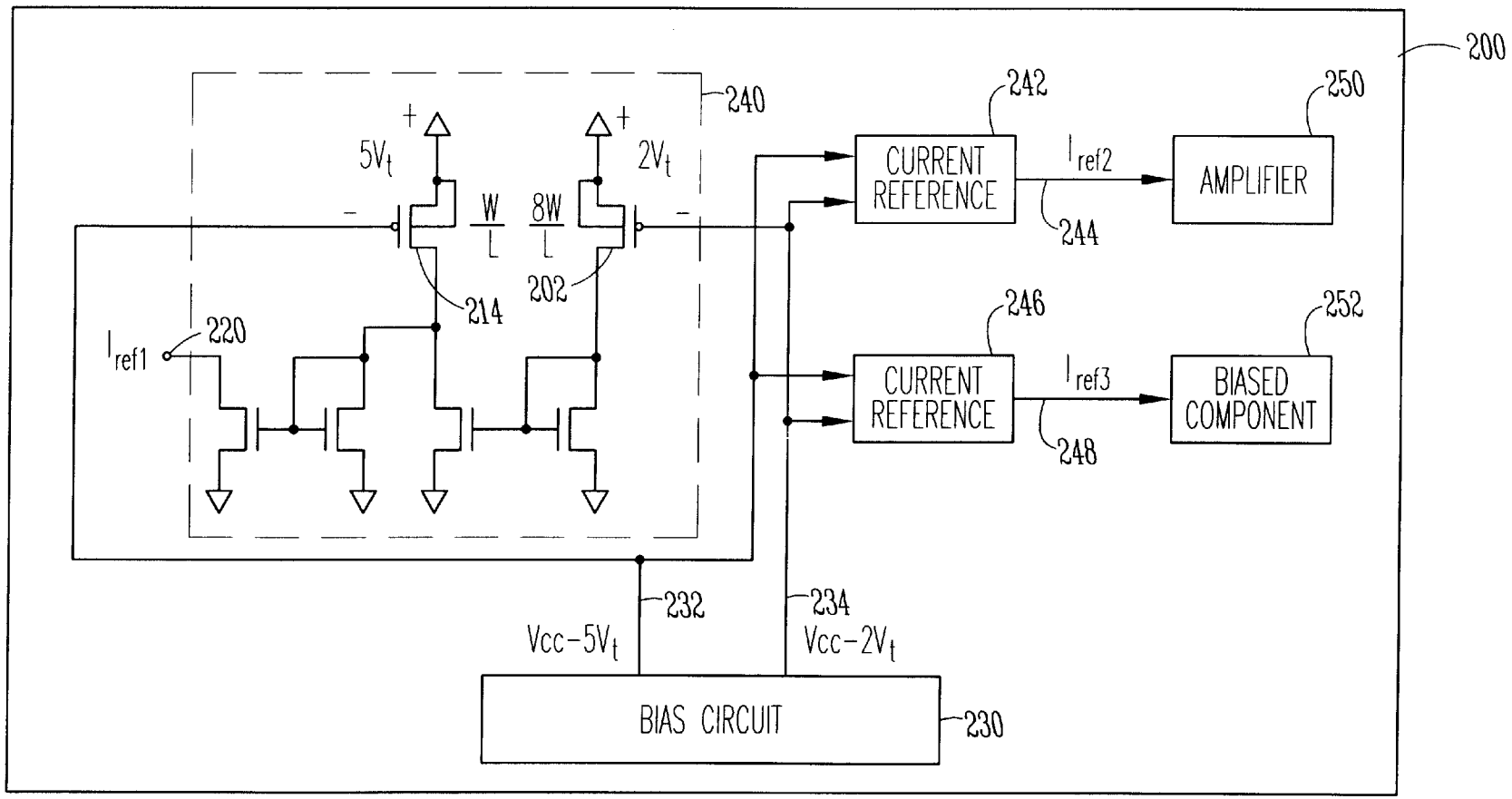
FIG. 2 shows an integrated circuit with multiple current reference circuits.

FIG. 2 shows an integrated circuit with multiple current reference circuits. Integrated circuit 200 includes current reference circuits 240, 242, and 246, bias circuit 230, amplifier 250 and biased component 252. Current reference circuit 240 includes control transistors 202 and 214 that satisfy set one of Table 1 above. Control transistor 202 is biased to $2V_t$, control transistor 214 is biased to $5V_t$, and control transistor 202 is sized eight times larger than control transistor 214. This provides a substantially process independent current $I_{ref1}$ at node 220.

Control transistor 202 receives a bias voltage of $V_{cc}-2V_t$ from bias circuit 230 on node 234. Control transistor 214 receives a bias voltage $V_{cc}-5V_t$ from bias circuit 230 on node 232. Bias circuit 230 is described with reference to FIG. 3 below. Current reference circuits 242 and 246 also receive bias voltages from bias circuit 230.

Current reference circuits 242 and 246 are current reference circuits such as current reference circuit 240. Current reference circuit 242 provides current $I_{ref2}$ to amplifier 250 on node 244, and current reference circuit 246 provides current $I_{ref3}$ to another biased component 252 on node 248. Biased component 252 can be any type of component capable of receiving a current from a current reference circuit.

Common bias voltage values among multiple current reference circuits allow the use of a common bias circuit, shown as bias circuit 230 in FIG. 2. In other embodiments, current reference circuits 240, 242, and 246 utilize dedicated bias circuits. Also, in some embodiments, different current reference circuits are sized and biased to satisfy different sets in Table 1, and use different bias circuits. In some embodiments, a single current reference circuit is used, and the output is routed throughout the integrated circuit. For example, integrated circuit 200 can include only current reference circuit 240, and output node 220 can be routed throughout.

Integrated circuit 200 includes multiple current reference circuits that generate process-independent reference currents without consuming a package pin for a precision resistor. As transistors become smaller and cheaper, and package pins become more scarce and expensive, current reference circuits such as those provided by the method and apparatus of the present invention become more useful.

Integrated circuit 200 can be any integrated circuit capable of including a current reference circuit such as current reference circuit 100 (FIG. 1) or 240 (FIG. 2). Integrated circuit 200 can be a processor such as a microprocessor, a digital signal processor, a microcontroller, or the like. Integrated circuit 200 can also be an integrated circuit other than a processor such as an application-specific integrated circuit (ASIC), a communications device, a memory controller, or a memory such as a dynamic random access memory (DRAM).

Figure 3:
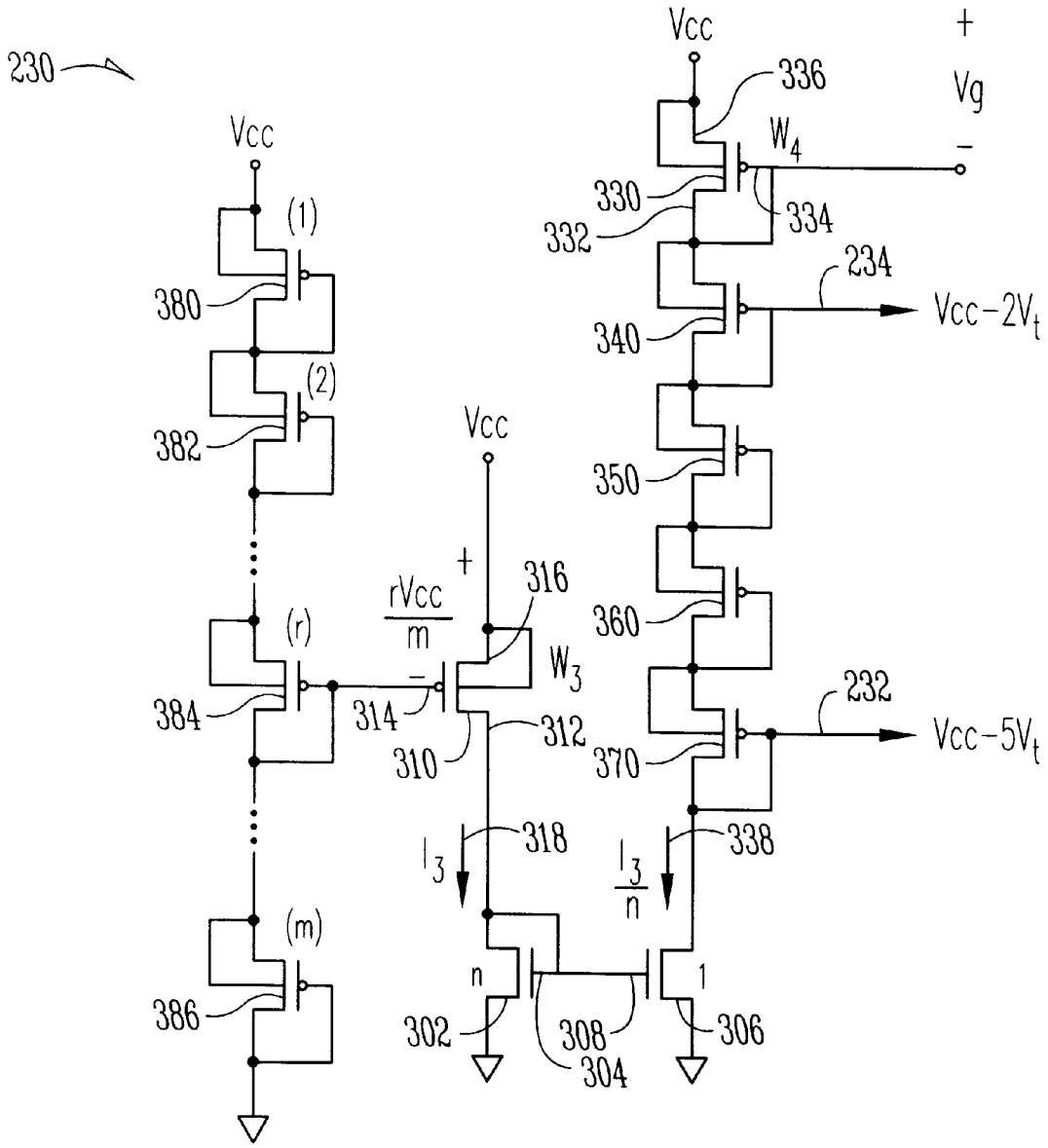
FIG. 3 shows a bias circuit.

FIG. 3 shows a bias circuit. Bias circuit 230 includes n-channel transistors 302 and 308 that form a current mirror. Bias circuit 230 also includes p-channel transistors 310, 330, 340, 350, 360, and 370. Transistor 310 is referred to as a "control" transistor, and transistors 330, 340, 350, 360, and 370 are referred to as "load" transistors. Control transistor 310 determines the current that controls operation of the current mirror. Through the action of the current mirror, control transistor 310 also determines the current that flows through load transistors 330, 340, 350, 360, and 370.

In some embodiments, all of the transistors of bias circuit 230 are long channel devices. In general, longer channel length allows for simpler design in part because the transistor behavior more closely approximates a theoretical behavior described below. Short channel devices can also be used. When short channel devices are used, circuit analysis can become more complicated in part because certain assumptions cannot be made. The analysis of the circuit with long channel devices is provided below.

Transistor 310 includes source 316, drain 312, and gate 314. Source 316 is coupled to an upper supply voltage node, shown as $V_{cc}$ in FIG. 3. Drain 312 is coupled to transistor 302 of the current mirror. Gate 314 is coupled to a node that provides a $V_{sg}$ substantially equal to $rV_{cc}/m$, where r/m is a constant. In the embodiment of FIG. 3, the voltage on gate 314 is provided by a circuit that includes p-channel transistors 380, 382, 384, and 386. This circuit, and the criteria for choosing a value for r/m, are discussed more fully below. For long channel transistors, the source-to-drain current through transistor 310 is given by:

$$I_3 = \beta\frac{W_3}{L}\left(\frac{rV_{cc}}{m} - V_t\right)^2 \tag{14}$$

where $W_3$ is the channel width and L is the channel length of transistor 310. $V_t$ is the threshold voltage of transistor 310, and $rV_{cc}/m$ is the voltage imposed from the source to the gate of transistor 310. "β" as described above, is a well known constant that is a function of the mobility of the majority carriers and the oxide capacitance of the transistor.

Transistor 302 is shown in FIG. 3 having size "n," and transistor 306 is shown having size "1." This creates a current ratio of 1/n for the current mirror made up from transistors 302 and 306. For example, current 318 conducts from drain to source in transistor 302 and has a value of $I_3$, and current 338 conducts from drain to source in transistor 306 and has a value of $I_3/n$. Current 318 is referred to as the "control" current.

Transistor 330 includes source 336, drain 332, and gate 334. Source 336 is coupled to an upper supply voltage node, shown as $V_{cc}$ in FIG. 3. Drain 332 is coupled through transistors 340, 350, 360, and 370 to transistor 306 of the current mirror. Gate 334 is coupled to drain 332, and therefore, transistor 330 is referred to as a "diode-connected" transistor. The source-to-drain current is set by the current mirror, and the value of the source-to-drain current in transistor 330 is $I_3/n$. The source-to-drain current through transistor 330 is given by:

$$\frac{I_3}{n} = \beta\frac{W_4}{L}(V_g - V_t)^2 \tag{15}$$

where $W_4$ is the channel width and L is the channel length of transistor 330. $V_t$ is the threshold voltage of transistor 330, and $V_g$ is the voltage on the gate of transistor 330.

Though it is not a requirement, we can assume that the length of transistors 310 and 330 are the same. Making this assumption, combining equations (14) and (15) and solving for $V_g$ yields $$V_g = V_t + \sqrt{\frac{W_3}{nW_4}}\left(\frac{rV_{cc}}{m} - V_t\right) \tag{16}$$

Equation (16) shows that the source-to-gate voltage on transistor 330 is the .sum of two voltage terms. The first of the voltage terms is the threshold voltage of transistor 330. The second of the voltage terms is a function of the channel widths of transistors 310 and 330, and also is a function of the difference between the source-to-gate voltage ($rV_{cc}/m$) and the threshold voltage ($V_t$) of transistor 310. If the second voltage term is near zero, then the source-to-gate voltage on transistor 330 approaches the threshold voltage of the transistor. The voltage on the gate of transistor 330 is equal to $V_{cc}-V_g$.

In some embodiments, the value of rim is chosen such that $rV_{cc}/m-V_t$ approaches zero. This makes the second voltage term of equation (16) also approach zero. In some embodiments, $nW_4$ is chosen to be much larger than $W_3$. This makes the square root term approach zero, which in turn makes the second voltage term approach zero. These embodiments result in the gate voltage on transistor 330 being an approximation of the threshold voltage ($V_t$).

The equations presented above assume that transistors 310 and 330 are in saturation. As a result, the second voltage term in equation (16) cannot go all the way to zero, because the gate voltage needs to be somewhat larger than the threshold voltage in order for the transistor to be on. The transistor must be on for the transistor to be in saturation. The second voltage term of equation (16), however, can be made very small and still maintain transistor 330 in saturation.

As the threshold voltage of transistor 330 varies over process and temperature, the source-to-gate voltage of transistor 330 tracks it. As transistor 330 becomes hotter and the threshold voltage becomes smaller, the source-to-gate voltage will also become smaller, and vice versa.

Thus far, the analysis has only considered transistor 330 in the stack of diode-connected transistors that includes transistors 330, 340, 350, 360, and 370. In the embodiment of FIG. 3, each of transistors 340, 350, 360, and 370 is a diode-connected transistor with a width $W_4$ that operates in the same manner as transistor 330, and the source-to-gate voltage on these transistors approximates the threshold voltage of the transistor. Any number of diode-connected transistors can be coupled in series in the fashion shown in FIG. 3.

Bias circuit 230 generates two voltages that are a function of the transistor threshold voltage. The gate of transistor 340 produces a voltage of approximately $V_{cc}-2V_t$, and the gate of transistor 370 produces a voltage of approximately $V_{cc}-5V_t$. The voltages are approximate because $V_g$ is a function of the transistor threshold voltage as described above with reference to equation (16). These voltages are provided as bias voltages on nodes 234 and 232. Bias circuit 230 generates voltages that are integer multiples of source-to-gate voltages. In other embodiments, non-integer multiples of source-to-gate voltages are generated using voltage dividers and buffers.

Bias circuit 230 also includes a control voltage generation circuit to generate the control voltage of $rV_{cc}/m$. The control voltage generation circuit includes "m" p-channel transistors, shown as p-channel transistors 380, 382, 384, and 386 in FIG. 3. The "m" p-channel transistors are coupled in series between $V_{cc}$ and ground, and each is diode-connected. Transistor 384 is shown schematically as transistor "r" in the series of "m" transistors, and the voltage on the gate of transistor 414 is $rV_{cc}/m$.

Any type of circuit can be used to generate the voltage of $rV_{cc}/m$, and the invention is not limited to the use of series diode-connected p-channel transistors as shown.

The p-channel transistors in bias circuit 230 are shown with the transistor body tied to the transistor source. This can be useful in some processes, such as n-well processes, in part because body effects can be reduced. Any of the transistors in any of the embodiments can be so connected.

FIGS. 1–3 show current reference circuits and bias circuits that have n-channel current mirrors and p-channel control and load transistors. The output voltages are a function of the threshold voltages of the p-channel transistors. In other embodiments, p-channel current mirrors and n-channel control and load transistors are used. In these embodiments, the output voltages are a function of the threshold voltages of the n-channel transistors.

Figure 4:
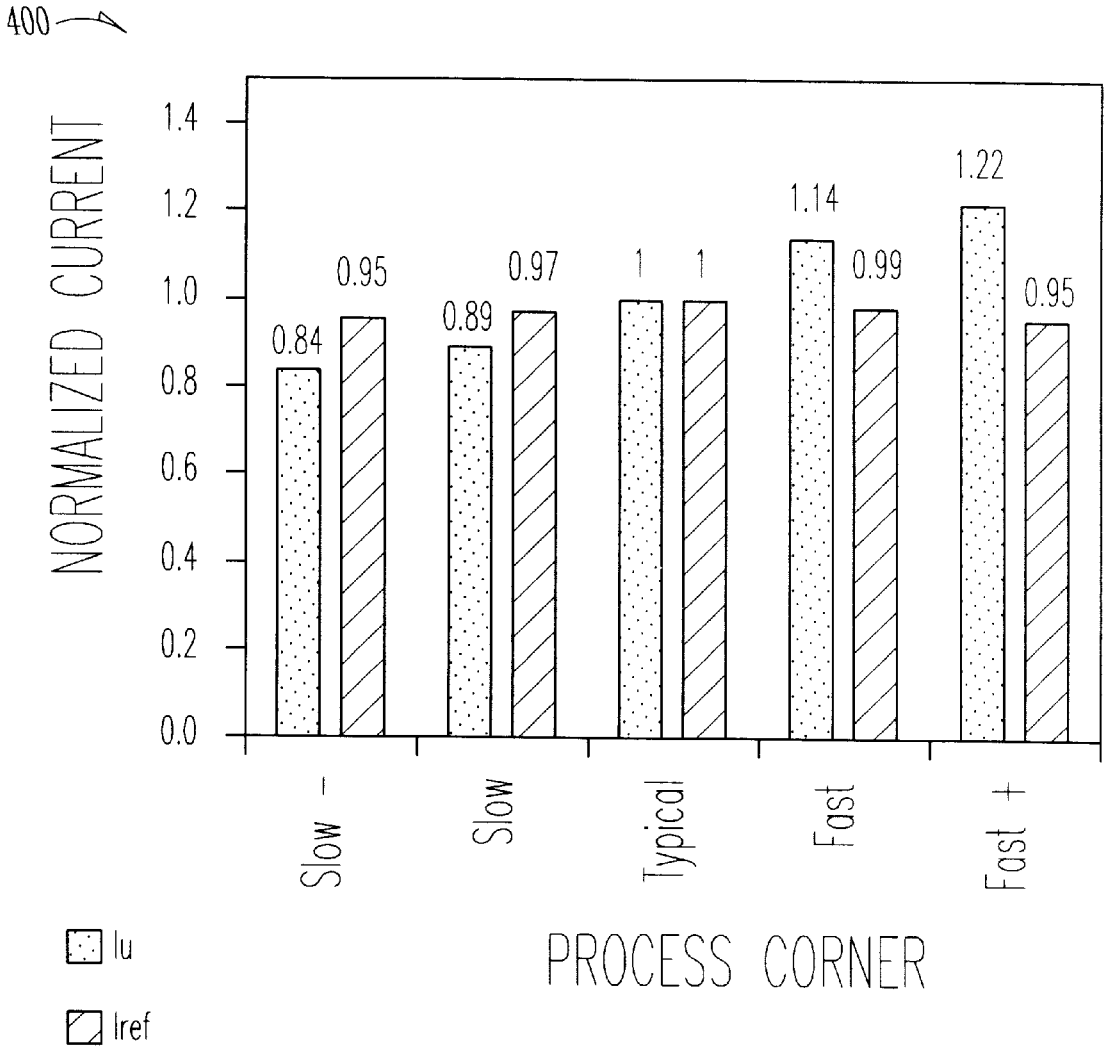
FIG. 4 shows a graph of simulation results.

FIG. 4 shows a graph of simulation results. Graph 400 shows uncompensated current ($I_u$) and compensated current ($I_{ref}$). $I_{ref}$ was generated using a simulation of current reference circuit 100 (FIG. 1) with a=2, b=5, and $z_1/z_2$=8. Bias circuit 230 (FIG. 3) was used to generate $aV_t$ and $bV_t$. The value of $z_1/z_2$ was manually optimized to minimize the $I_{ref}$ current variation, and the final value was approximately $z_1/z_2$=⅙. The simulation results indicate that normalized process variation in $I_u$ was 0.48, while the normalized process variation in $I_{ref}$ was 0.05. $V_{cc}$ was 900 mv. With a $V_y$ of approximately 100 mv, bias circuit 230 had enough headroom to generate $5V_t$. FIG. 4 shows representative results. Process variation impact can be different depending on the technology and design.

It is to be understood that the above description is intended to be illustrative, and not restrictive. Many other embodiments will be apparent to those of skill in the art upon reading and understanding the above description. The scope of the invention should, therefore, be determined with reference to the appended claims, along with the full scope of equivalents to which such claims are entitled.

What is claimed is:

1. A current reference circuit comprising:

a first current mirror having a diode-connected transistor and a second transistor to force a second current in the second transistor to be substantially equal to a first control current in the diode-connected transistor;

a first control transistor to provide the first control current in the diode-connected transistor;

a second control transistor coupled to the second transistor to provide a second control current; and an output node formed at a junction between the second control transistor and the second transistor of the first current mirror, the output node being configured to provide a first output current, the first output current being substantially equal to a difference between the second control current and the second current.

2. The current reference circuit of claim 1 further comprising:

a second current mirror to receive the first output current from the output node.

3. The current reference circuit of claim 2 wherein the first output current is substantially process-independent.

4. A current reference circuit comprising:

a first current mirror having a diode-connected transistor and a second transistor to force a second current in the second transistor to be substantially equal to a first control current in the diode-connected transistor;

a first control transistor to provide the first control current in the diode-connected transistor;

a second control transistor coupled to the second transistor to provide a second control current; and an output node formed at a junction between the second control transistor and the second transistor of the first current mirror;

wherein the first and second control transistors include gates coupled to bias nodes to bias the gates with bias voltages that are a function of a threshold voltage of the first and second control transistors.

5. The current reference circuit of claim 4 wherein the first and second control transistors are sized such that the first and second control currents vary by substantially the same amount over process variations.

6. The current reference circuit of claim 4 further including a first bias circuit coupled to the gate of the first control transistor, the first bias circuit including components to provide a first source-to-gate bias voltage that varies with the threshold voltage of the first control transistor.

7. The current reference circuit of claim 6 further including a second bias circuit coupled to the gate of the second control transistor, the second bias circuit including components to provide a second source-to-gate bias voltage that varies with the threshold voltage of the second control transistor.

8. The current reference circuit of claim 6 wherein the first bias circuit comprises a plurality of diode-connected transistors coupled in series.

9. The current reference circuit of claim 4 wherein the gate of the first control transistor is coupled to a first bias circuit to be biased with a first source-to-gate bias voltage substantially equal to an integer multiple of the threshold voltage.

10. A current reference circuit comprising:

a first current mirror having a diode-connected transistor and a second transistor to force a second current in the second transistor to be substantially equal to a first control current in the diode-connected transistor;

a first control transistor to provide the first control current in the diode-connected transistor;

a second control transistor coupled to the second transistor to provide a second control current; and an output node formed at a junction between the second control transistor and the second transistor of the first current mirror;

wherein the first control transistor includes a gate coupled to a first bias node to bias the first gate to a voltage of $aV_t$, where a is a constant and $V_t$ is the threshold voltage of the first control transistor;

and wherein the second control transistor includes a gate coupled to a second bias node to bias the second gate to a voltage of $bV_t$, where b is a constant; and $$(b-1)(a-1)=4.$$

11. The current reference circuit of claim 10 wherein a size ratio of the second control transistor to the first control transistor substantially satisfies the equation:

$$\left(\frac{a-1}{b-1}\right)^{\frac{3}{2}}.$$

12. A current reference circuit comprising:

a first control transistor to provide a first control current;

a second control transistor to provide a second control current; and an output node coupled between the first and second control transistors to provide a difference current substantially equal to a difference between the first and second control currents;

wherein the first and second control transistors are biased and sized such that the difference current is substantially constant over process variations.

13. The current reference circuit of claim 12 further comprising:

a current mirror coupled between the first control transistor and the second control transistor; and a bias circuit to bias the first control transistor to a multiple of a threshold voltage.

14. A current reference circuit comprising:

a first control transistor to provide a first control current;

a second control transistor to provide a second control current;

an output node coupled between the first and second control transistors to provide a difference current substantially equal to a difference between the first and second control currents, wherein the first and second control transistors are biased and sized such that the difference current is substantially constant over process variations;

a current mirror coupled between the first control transistor and the second control transistor; and a bias circuit to bias the first control transistor to a multiple of a threshold voltage;

wherein the bias circuit comprises a plurality of diode-connected transistors coupled in series with the path of a generated current to generate a voltage substantially equal to a multiple of one threshold voltage.

15. A current reference circuit comprising:

a first control transistor to provide a first control current;

a second control transistor to provide a second control current;

an output node coupled between the first and second control transistors to provide a difference current substantially equal to a difference between the first and second control currents, wherein the first and second control transistors are biased and sized such that the difference current is substantially constant over process variations; and a bias circuit to bias the first control transistor to a voltage of $aV_t$, and to bias the second control transistor to a voltage of $bV_t$ such that $(b-1)(a-1)=4$, wherein a and b are constants and $V_t$ is a threshold voltage of the control transistors.

16. The current reference circuit of claim 15 wherein a and b are integers.

17. The current reference circuit of claim 15 wherein a and b are non-integers.

18. The current reference circuit of claim 15 wherein a size ratio of the second control transistor to the first control transistor substantially satisfies the equation:

$$\left(\frac{a-1}{b-1}\right)^{\frac{3}{2}}.$$

19. The current reference circuit of claim 15 wherein the bias circuit comprises:

a plurality of diode-connected transistors connected in series having a generated current therethrough; and a current mirror to provide the generated current such that each of the plurality of diode-connected transistors has a voltage drop of substantially one threshold voltage.

20. An integrated circuit comprising:

a first current source having an output node to produce an output current that varies with a size and bias of a first control transistor;

a second current source having an input node to receive an input current, the input node being coupled to the output node of the first current source, such that the output current of the first current source influences the operation of the second current source; and a second control transistor coupled to the input node of the second current source;

wherein the first and second control transistors have threshold voltages, and the first and second control transistors are coupled to a bias circuit to bias the first and second control transistors as a function of the threshold voltages.

21. The integrated circuit of claim 20 wherein:

the bias circuit biases the first control transistor to a voltage of $aV_t$ and biases the second control transistor to a voltage of $bV_t$ such that $(b-1)(a-1)=4$; and a and b are constants and $V_t$ is the threshold voltage of the first and second control transistors.

22. The integrated circuit of claim 21 wherein a and b are integers.

23. The integrated circuit of claim 21 wherein a and b are non-integers.

24. The integrated circuit of claim 21 wherein a size ratio of the second control transistor to the first control transistor substantially satisfies the equation:

$$\left(\frac{a-1}{b-1}\right)^{\frac{3}{2}}.$$

25. The integrated circuit of claim 21 further including the bias circuit, wherein the bias circuit comprises:

a plurality of diode-connected transistors connected in series having a generated current therethrough; and a current mirror to provide the generated current such that each of the plurality of diode-connected transistors has a voltage drop of substantially one threshold voltage.

* * * * *

UNITED STATES PATENT AND TRADEMARK OFFICE

CERTIFICATE OF CORRECTION

PATENT NO. : 6,346,803 B1
DATED : February 12, 2002
INVENTOR(S) : Grossnickle et al.

It is certified that error appears in the above-identified patent and that said Letters Patent is hereby corrected as shown below:

Column 6,
Line 34, delete ".sum" and insert -- sum --, therefor.
Line 44, delete "rim" and insert -- r/m --, therefor.

Signed and Sealed this

Twenty-third Day of April, 2002

*Attest:*

*Attesting Officer*

JAMES E. ROGAN
*Director of the United States Patent and Trademark Office*